US006129638A

United States Patent [19]

Davis

[11] Patent Number: 6,129,638

[45] Date of Patent: Oct. 10, 2000

[54] GOLF SWING TRAINING APPARATUS

[76] Inventor: Keith Davis, 27563½Oak Springs Canyon Rd., Canyon Country, Calif. 91351

[21] Appl. No.: 09/358,743

[22] Filed: Jul. 21, 1999

Related U.S. Application Data

[60] Provisional application No. 60/093,660, Jul. 22, 1998, abandoned.

[51] Int. Cl.[7] ..... A63B 69/36

[52] U.S. Cl. ..... 473/215; 473/277

[58] Field of Search ..... 473/274, 277, 473/207, 208, 215, 216, 266, 422, 424

[56] References Cited

U.S. PATENT DOCUMENTS

| | | | |
|---|---|---|---|
| 3,940,144 | 2/1976 | Dickie | 473/215 |
| 4,706,957 | 11/1987 | Jackson | 473/217 |
| 4,955,608 | 9/1990 | Dougherty et al. | 473/422 |
| 5,188,365 | 2/1993 | Picard | 473/215 |
| 5,303,927 | 4/1994 | Perry et al. | 473/215 |
| 5,704,856 | 1/1998 | Morse | 473/422 |

*Primary Examiner*—Kien T. Nguyen
*Attorney, Agent, or Firm*—Roger A. Marrs

[57] ABSTRACT

A golf swing training apparatus including a waist belt to be worn about the girth of the user having a downwardly depending leg strap with one end adjustably attached to the waist belt while the opposite end terminates in a pair of retaining straps. The leg strap is trained between the legs of the user so that a flexible resilient member extends about the leg intended to be immobilized while the restraining straps extend across the front of the user and releasably extend above and below the opposite knee. The retaining straps are arranged in fixed spaced-apart relationship so that the knee comfortably is positioned between the straps. Swinging movement by the upper torso of the user is permitted in a normal way; however, the knee having the resilient member extended thereabout is immobilized since one end of the leg strap is secured to the waist belt while the other end of the leg strap is releasably attached to the opposite leg.

7 Claims, 2 Drawing Sheets

FIG. 4
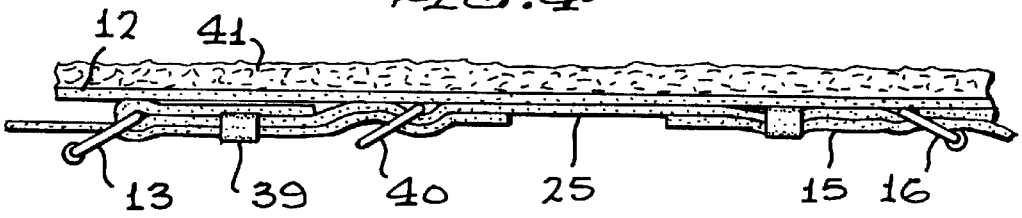
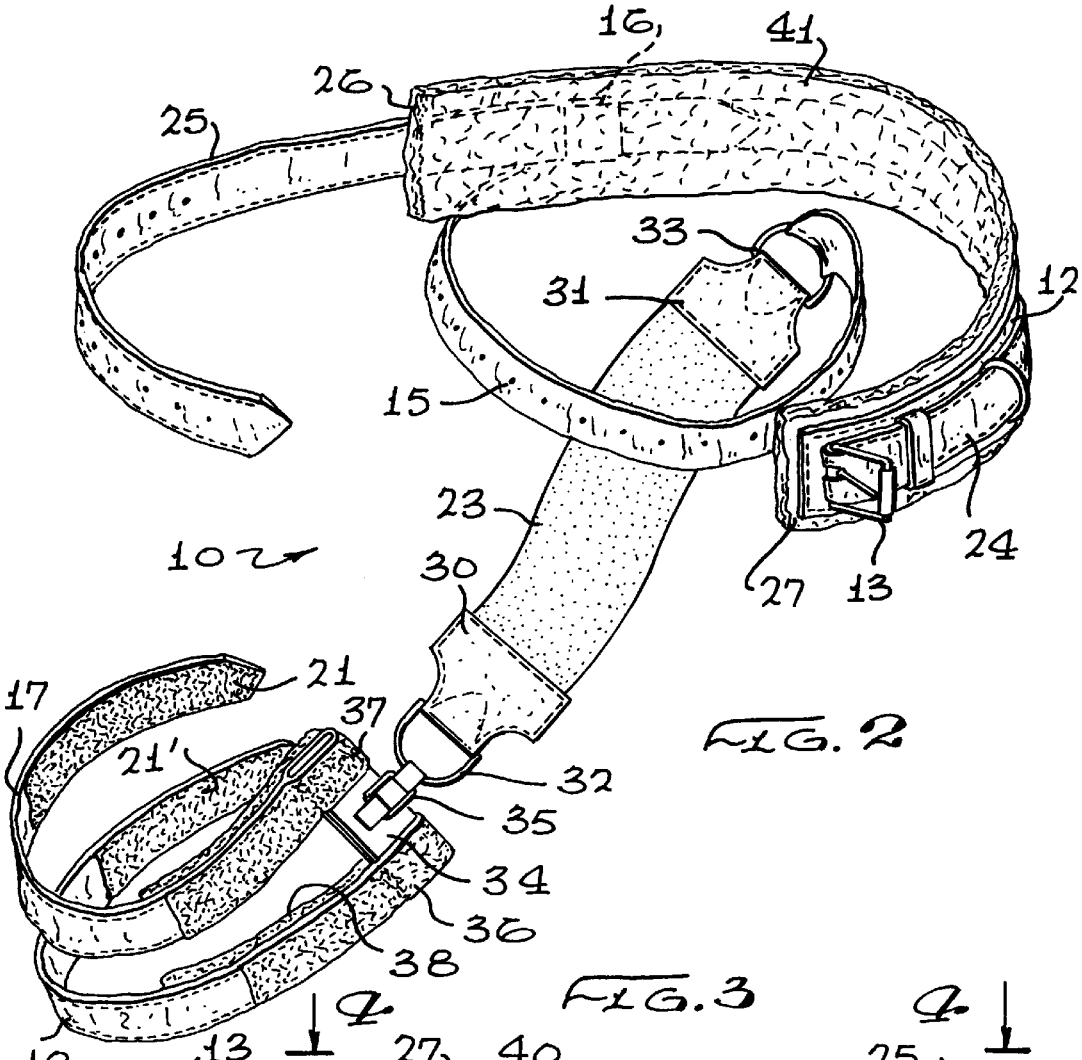
FIG. 2
FIG. 3
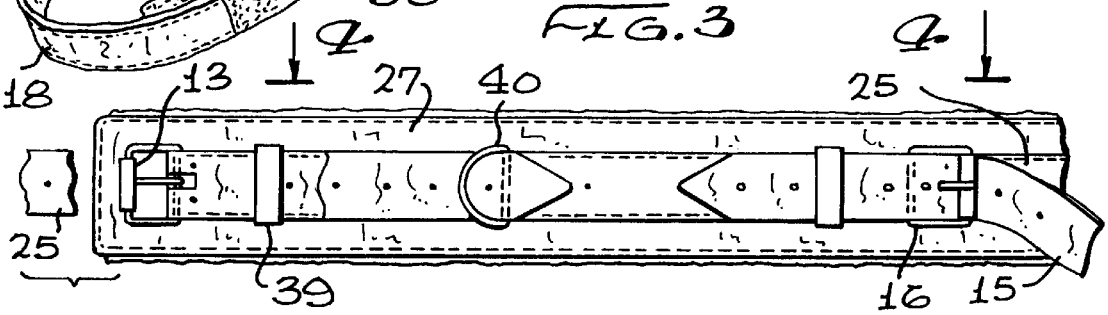

GOLF SWING TRAINING APPARATUS

Priority Claim based on the provisional application Ser. No. 60/093,660 filed Jul. 22, 1998 now abandoned

BACKGROUND OF THE INVENTION

1. Field of the Invention

The present invention relates to the field of training devices usable for the development of skills in various sporting activities, and more particularly to a golf training device useful to detect and correct certain faults in an improper golf swing.

2. Brief Description of the Prior Art

In the playing of golf, proper technique in the physical skills is extremely important in playing the game correctly and successfully. For example, in golf, the swing of the golf club is the most important part of a person's golf game and is the physical skill which has the most bearing on the person's golfing ability. Although there are many theories and principles as to how to achieve a correct golf swing, there is general agreement with respect to many parts of the golf swing, particularly the relative position of certain body parts to others or the relative movement of certain body parts with respect to some reference member other than the golfer's body. For example, it is well accepted that the right leg of a right-handed golfer should remain relatively straight and immobile during the swing in order to prevent swaying of the leg and body and resulting loss of control over the point of contact between the club face and the golf ball. A common mistake for beginners is the movement of the right knee to the outside and straightening the right knee during the golf swing. Also, a hip turn is experienced during the swing which is a factor requiring control. The concept that the hip turn, not upper body strength, is the foundation of the golf swing that is difficult for a beginner to grasp. The principle is even more difficult to put into practice as it is unnatural movement.

Therefore, a long-standing need has existed to provide a golf swing training aid which assists in prevention of negative habits that can take years to correct once established. Even for experienced golfers, the features of the golf swing need to be improved to prevent the exiting of proper frame insuring no power or accuracy is lost throughout the swing. The need exists for an apparatus which may be temporarily worn by a golfer which relates to the lower body in order to maintain that the right leg of a right-handed golfer can be maintained in a proper position so that it is relatively immobile during the course of the swing. The device should be applicable to left-handed golfers as well and the device should insure that the right knee is maintained in its proper inverted position throughout the golf swing procedure.

SUMMARY OF THE INVENTION

Accordingly, the above problems and difficulties are avoided by the present invention which provides a novel golf swing training apparatus having a waist belt adapted to comfortably adjust to the girth of the user and which further includes a downwardly depending leg strap having one end adjustably attached to the waist belt while the opposite end of the leg strap terminates in a pair of retaining straps. The leg strap further includes a resilient member which is intended to reside behind the leg intended to be maintained immobile. The leg strap is trained between the legs of the user so that the resilient member extends about the leg intended to be immobilized while the restraining straps extend across the front of the user and releasably extend above and below the opposite knee. The retaining straps are arranged in fixed spaced-apart relationship so that the knee comfortably is positioned between the straps. Swinging movement by the upper torso of the user is permitted in a normal way; however, the knee having the resilient member extended thereabout is immobilized since one end of the leg strap is secured to the waist belt while the other end of the leg strap is releasably attached to the opposite leg.

Therefore, it is among the primary objects of the present invention to provide a novel golf training device capable of developing skills in various sporting activities such as golf without the presence of an instructor to detect an improper performance or accomplishment of such skill.

Yet another object of the present invention is to provide a novel golf swing training device for beginners which provides a correct "feel" so as to prevent negative habits that can take years to correct once established.

Yet another object of the present invention is to provide a novel golf swing training apparatus which produces a proper golf swing when worn by a golfer and which is accomplished by training the golfer's lower body in such a manner that the device keeps the right knee stationary and produces hip turn follow-through on the golfer's down swing.

Still a further a further object resides in providing a golf swing training device which pertains to the golfer's lower body where proper swing mechanics determine swing performance.

Furthermore, the novel golf swing training device of the present invention provides a waist strap with a leg strapping device extending downwardly from the hip or waist belt which is extended around the leg intended to be immobilized while the terminating end is releasably attached to the other leg. By this means, a gravitational pull is experienced as the golfer swings the golf club so that the force pulls the golfer's hip around in a twist producing a proper down swing.

Prior training devices are disclosed in U.S. Pat. Nos. 5,295,690; 5,050,885; 5,125,663 and 5,255,921. All of these prior devices suffer from the above-noted problems and, in particular, relate to upper body training for conditioning arms, hands and wrist movements.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 2 is a front perspective view of the golf swing training apparatus used by the golfer in FIG. 1;

FIG. 3 is a fragmentary front elevational view of the waist or hip band used in the apparatus shown in FIGS. 1 and 2; and FIG. 4 is a top fragmentary view of the waist or hip band shown in FIG. 3 as taken in the direction of arrows 4–4 thereof.

DESCRIPTION OF THE PREFERRED EMBODIMENT

Figure 1:
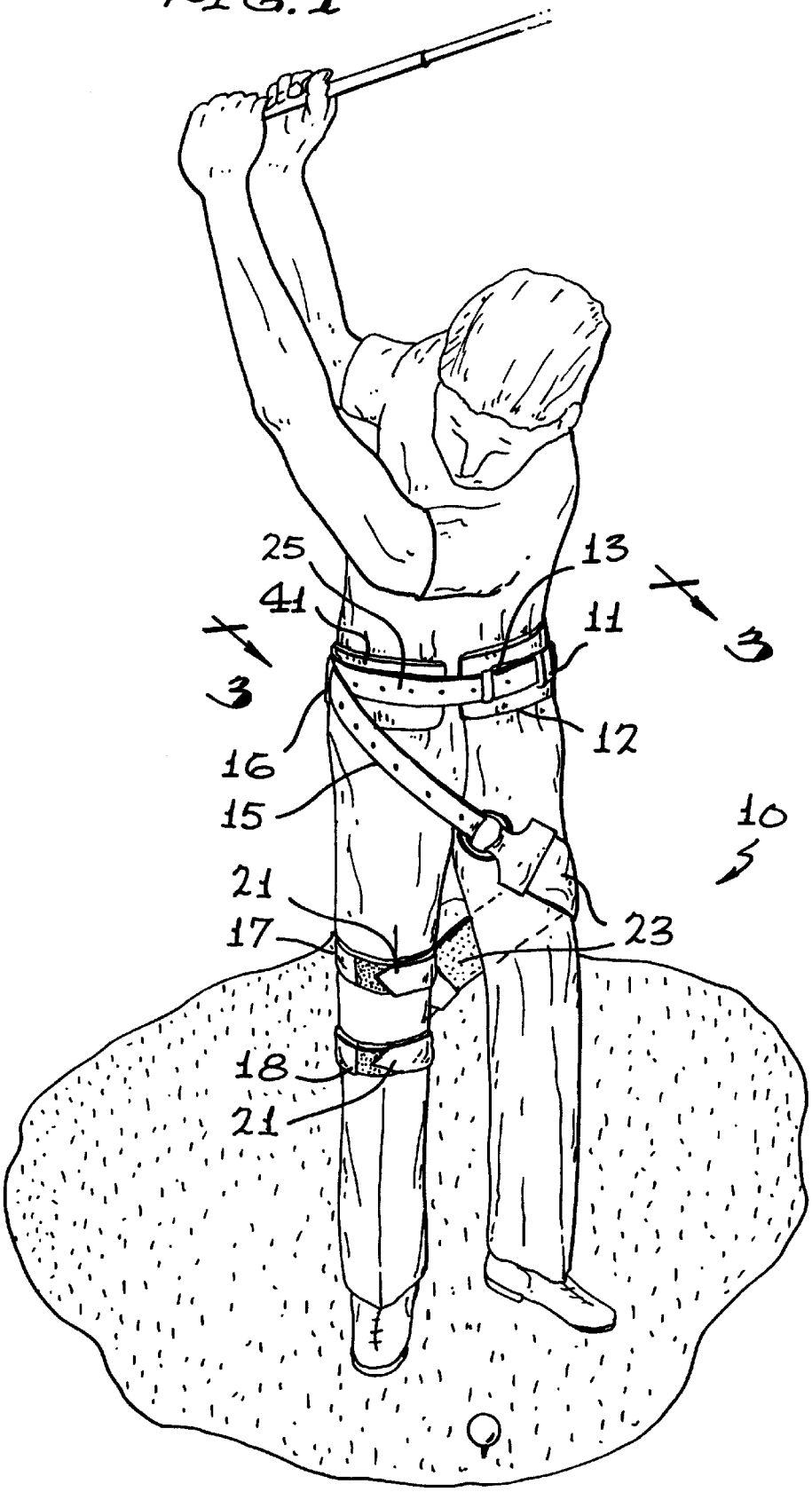
FIG. 1 is a front elevational view of a golfer using the novel golf swing training apparatus of the present invention.

Referring to FIG. 1, the novel golf swing training apparatus of the present invention is illustrated in the general direction of arrow 10 which includes a waist or hip belt 11 adapted to be worn about the waist or hip of the user. The waist or hip belt 11 is an elongated length of material, such as leather, and is indicated by numeral 12. The elongated leather length further includes a buckle comprising a pair of straps carried on the terminal ends of the belt 12 and which are joined together by means of a buckle 13. The buckle is releasable and may take the form of Velcro, tongue or tang in hole or any other releasable arrangement. The inside of the hip or waist belt 12 may include a cushion material, such as a soft and pliable foam, wool-like material, or any other suitable cushion.

It is to be particularly noted that the waist or hip belt 12 further includes a downwardly depending leg strap, indicated by numeral 15, having one end adjustably connected to the waist belt by means of a buckle 16. The opposite end of the leg belt or strap 15 extends across the front of the golfer and terminates in a pair of retaining straps 17 and 18 which are in fixed spaced-apart relationship so as to be releasably fastened above and below the golfer's knee. The retaining strap is held in position by joining the opposite ends of each strap using a hook and pile fastening relationship, as indicated by numerals 20 and 21 respectively. The downwardly depending leg strap 15 includes a resilient or elastic member, indicated by numeral 23, which is wrapped about the front and back of the leg before extending behind the golfer's legs for attachment of the retaining straps 17 and 18. Therefore, it can be seen that as the golfer twists or maneuvers the upper body, the elastic element 23 will cause resistance to any leg movement about which it is extended.

Referring now in detail to FIG. 2, it can be seen that the belt 12 further includes a closure strap consisting of leather straps 24 and 25 wherein their opposite ends form the releasable buckling means 13 when attached together. The respective straps 24 and 25 are carried on the opposite ends of the main support waist or hip belt 12 so that when the belt 12 is placed about the hip or waist of the user, opposite ends thereof, represented by numerals 26 and 27, are in fixed spaced-apart relationship as shown in FIG. 1.

The leg strap 15 is adjustably coupled to the strap 25 by means of the buckle arrangement 16. It can be seen that the elastic or extendable element 23 has leather attachment fittings 30 and 31 carried on the opposite ends thereof and on which each of the fittings terminate in a coupling ring, such as rings 32 and 33. Coupling ring 33 is attached to the end of strap 15 while coupling ring 32 is attached to the leg retaining straps via a yoke 34 and a linkage 35.

FIG. 2 also reveals that the strap ends 21 and 21' for each of the leg straps 17 and 18 are releasably coupled to hook and pile components, identified by numerals 36 and 37. Cushion or softening material, such as wool or foam, can be carried on each of the respective leg straps as identified by numeral 38.

Referring now in detail to FIG. 3, it can be seen that the belt 12 carries the belt strap 25 which, in turn, carries the leg strap 15. The end of strap 25 terminates in the buckle 13 at end 27 of the waist or hip belt 12 while the opposite end of belt or strap 25 terminates in closure with the buckle 13. The strap further includes a keeper 39 and a ring 40 for insertably receiving the end of belt 25.

The belting closure arrangement for fasteners 13 and 16 is shown more clearly in FIG. 4. It can be seen that the inside of belt 12 includes a cushion material, identified by numeral 41, that may take the form of natural wool, foam or the like. When it is desired to lengthen or shorten the leg strap 15, the buckle 16 is released to permit adjustment.

With regard to the elastic or extendable material 23, it is resilient and will expand of contract depending upon the lower body forces or torque applied thereto during the golfer's swing. The resistance of the strap's expandable element 23 places a force against the outside leg of the user which prevents the leg from moving outwardly during the course of a golf club swing. This is the exact movement which is desired by the golfer during the swing procedure. In principle, applied forces are loaded within the golfer's body to develop the driving force and it is intended that the driving force not be in the use of arms or hands. The development of training devices for upper body is conventional; however, it is the lower body control that the present invention is directed towards. The present invention keeps the body stable and does not permit the leg to move about which the extendable or expandable member or element 23 is wrapped. Torque is built up in the lower body and this provides the driving force which is impacted through the club to the golf ball.

In view of the foregoing, it can be seen that the gravitational force provided by the present invention to the lower body of the user produces a proper golf swing. This is accomplished by keeping the right knee stationary and reducing hip turn follow-through on the golfer's down swing mainly through the use of the expandable resilient member 23. Moving the right knee towards the outside and straightening the right knee are common mistakes which beginners and advanced golfers make. The use of the present invention contains the right knee in its proper inverted position through the use of the stationary strap 25 extending around the hip or waist belt 12. It also keeps the knee in its proper "sitting" stance through the extendable mechanism or element 23 on the back of the knee. For beginners, these features provide the correct "feel" and help to prevent negative habits that can take years to correct, once established. For more experienced golfers, these features prevent the exiting of proper frame insuring no power or accuracy is lost throughout the swing.

The leg strap 15 extending from the waist or hip belt 25 is not only adjustable but provides a resistance when it is extended about the leg of the user. The leg strap, including the expandable element 23 and restraining straps 17 and 18 produces a gravitational pull. When the golfer reaches the top of his back swing, the force pulls the golfer's hip around so as to produce a proper down swing. For beginners, an automatic hip turn is created. This concept that the hip turn, not of the body strength, is the foundation of the golf swing and is difficult for a beginner to grasp. This principle is even more difficult to put into practice as it is an unnatural movement. This feature of the product gives the beginner a great edge in attaining a proper swing from the start. For the advanced golfer, who has fallen into bad habits using his hands, this aspect of the inventive concept aids him in placing hips first, greatly improving his distance, trajectory and accuracy. The novel golf swing training apparatus 10 relates to the lower body where proper swing mechanics derive and for safety, the device has knee and back supports so that the golfer is actually more comfortable than if he were hitting with no training apparatus at all.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A golf swing training apparatus comprising:

an elongated waist belt having opposite ends;

an adjustable securement means cooperatively carried on said opposite ends of said waist belt for joining said opposite ends together;

a leg strap downwardly depending from said waist belt having opposite ends with one end adjustably attached to said waist belt and the other end terminating in a pair of retaining straps; and said leg strap having a resilient member midway between said opposite ends.

2. The training apparatus defined in claim 1 wherein:

said leg strap resilient member is an elongated sheet of flexible and stretchable material having opposite ends connected to said retaining straps and an adjustable section of said leg strap respectively.

3. The training apparatus defined in claim 2 wherein:

said opposite ends of said resilient member are coupled to said retaining straps and said adjustable section by a pivotal ring and loop combination whereby said leg strap is fully articulated during the practice golf swing.

4. The training apparatus defined in claim 3 wherein:

said adjustable section is releasably attached to said waist belt.

5. The training apparatus defined in claim 4 wherein:

said retaining straps including cushion material and hook and pile fasteners adjustably connecting each of said retaining straps together.

6. The training apparatus defined in claim 1 wherein:

said resilient member is a sheet of stretchable material disposed behind a leg of the user intended to be maintained immobile during a practice golf swing; and said pair of retaining straps are of non-stretchable material and in spaced-apart relationship and extend across the front of the user separated by the knee of the user.

7. The training apparatus defined in claim 1 wherein:

said waist belt includes adjustable means for adjusting the length of said waist belt;

said waist belt, said leg strap and said retaining straps are worn by a golfer's lower body so as to keep the golfer's right knee stationary while permitting hip turn follow-through on the golfer's down swing; and said retaining straps including a pair of adjustable straps in spaced-apart relationship.

* * * * *